United States Patent [19]

Killingsworth

[11] Patent Number: 4,719,471

[45] Date of Patent: Jan. 12, 1988

[54] ANGULATED FM ANTENNA

[75] Inventor: Emmett D. Killingsworth, Raleigh, N.C.

[73] Assignee: Westinghouse Electric Corp., Pittsburgh, Pa.

[21] Appl. No.: 820,357

[22] Filed: Jan. 21, 1986

[51] Int. Cl.[4] ..... H01Q 9/16

[52] U.S. Cl. ..... 343/792; 343/791; 343/793; 343/808; 343/822

[58] Field of Search ..... 343/790, 791, 792, 793, 343/808, 822

[56] References Cited

U.S. PATENT DOCUMENTS

| | | | |
|---|---|---|---|
| 3,155,976 | 11/1964 | Wickersham et al. | 343/814 |
| 3,335,420 | 8/1967 | Silliman | 343/793 |
| 3,448,454 | 6/1969 | Lane | 343/742 |
| 3,576,578 | 4/1971 | Harper | 343/791 |
| 3,656,167 | 4/1972 | Lea | 343/793 |
| 3,980,954 | 9/1976 | Whyte . | |
| 4,048,619 | 9/1977 | Forman et al. . | |
| 4,112,369 | 9/1978 | Forman et al. . | |
| 4,196,310 | 4/1980 | Forman et al. . | |
| 4,199,761 | 4/1980 | Whyte et al. . | |
| 4,222,053 | 9/1980 | Newcomb | 343/722 |
| 4,417,349 | 11/1983 | Hills et al. . | |
| 4,485,385 | 11/1984 | Ralston | 343/795 |
| 4,494,122 | 1/1985 | Garay et al. | 343/792 |

*Primary Examiner*—William L. Sikes
*Assistant Examiner*—Doris J. Johnson
*Attorney, Agent, or Firm*—G. E. Hawranko

[57] ABSTRACT

An FM antenna utilizes a generally rigid conductive element, as a dipole segment, that is connected in electrical communication with a capacitive segment. The capacitive segment can be manufactured from a preselected length of coaxial cable with the central conductor of the coaxial cable being connected in electrical communication with the dipole segment and with the cylindrical conductor, or braided shield, of the coaxial cable being connected to an electrical ground. A variable inductor is connected in electrical communication with the central conductor of the coaxial cable between the capacitive segment and an FM receiver. The central conductor of the capacitive element is connected serially between the dipole segment and the variable inductor. This configuration provides an omnidirectional antenna for use with FM receivers that is relatively small in size and inexpensive to manufacture.

7 Claims, 4 Drawing Figures

ANGULATED FM ANTENNA

BACKGROUND AND SUMMARY OF THE INVENTION

The present invention relates generally to antennas and, more specifically, to an FM antenna that is omnidirectional, small, inexpensive and easily manufactured.

Various systems have been developed which utilize means for broadcasting signals from a central station to one or more remote stations for the purpose of communicating digital information or for controlling the operation of the remote station. Some of these systems utilize FM broadcasting technology and, more particularly, subsidiary communications authorization (SCA) channels. U.S. Pat. No. 4,199,761 which issued on Apr. 22, 1980 to Whyte et al. discloses an automated electric power distribution network that includes a radio communication system for transmitting multipurpose, mutitone signals in one or more signaling channels over the auxiliary channel or channels of one or more commercial broadcasting stations. Energy management terminals receive the signals at remote locations that are served by the electric distribution network. Radio receivers located at the terminals have frequency selective detectors that are responsive to different multitone signals. U.S. Pat. No. 3,980,954 which issued on Sept. 14, 1976 to Whyte discloses an arrangement of communication components to provide communications between a central control center and various customer load locations in an electrical power distribution system. Control or interrogation signals originate at the control center and are transmitted over a suitable facility, such as a telephone line, to an FM broadcasting station. The control signals frequency modulate an ultrasonic subcarrier which modulates the FM broadcast program material. Radio receivers at the customer load locations receive, filter and decode the broadcast signals which are used to activate the control or logic circuits associated with the customer location. U.S. Pat. Nos. 3,980,0954 and 4,199,761 are hereby incorporated by reference.

U.S. Pat. No. 4,196,310 which issued on Apr. 1, 1980 to Forman et al. discloses an FMSCA broadcasting system that includes subscriber-actuated portable receiving terminals. It describes an information broadcasting system that includes a central transmitting station for encoding data in binary form utilizing a key word and transmitting an FMSCA signal shift modulated by the encoding data. U.S. Pat. No. 4,112,369 which issued on Sept. 5, 1978 to Forman et al. discloses a similar system which comprises portable terminals that include a receiver for decoding and phase-shifting FMSCA signals into encoded binary data.

U.S. Pat. No. 4,048,619 which issued on Sept. 13, 1977 to Forman et al. discloses an information broadcasting system that includes a central broadcasting station for encoding data in binary form utilizing a key word and transmitting on one frequency an FMSCA signal phase shift modulated by the encoded data. The encoded data is also supplied to one or more remote broadcasting stations, typically via telephone lines, where it is transmitted on a second frequency as an FMSCA signal phase shift modulated by the encoded data.

U.S. Pat. No. 4,417,349 which issued on Nov. 22, 1983 to Hills et al. discloses an FMSCA data transmission system with a raised cosine filter. Digital data is transferred via the subcarrier of a commercial broadcast FM radio station. Digital data generated by an originating subscriber is shaped with substantially a raised cosine response in the time domain. The shaped signal is then pre-emphasized and used to frequency-modulate a subcarrier. The subcarrier in turn frequency-modulates the carrier and the data is transmitted by the radio station along with its commercial program.

When digital data is broadcast from a central location by an electric utility company for the purpose of performing load control functions, the electrical energy consumers are provided with a load control terminal which is configured to respond to the broadcast signals by selectively opening or closing relay contacts that control the flow of electrical power to selected appliances. Typically, the relays of a load control terminal are associated with appliances that can be shed without incurring undue hardship to the electrical energy consumer. For example, water heaters and air-conditioners are typical appliances that can be disconnected during periods of peak demand without placing undue hardship on the electrical consumer.

Radio signal receivers, such as load control terminals used by electric utility companies to regulate peak demand, require an antenna for the purpose of receiving the broadcast information. In situations where no spatial restrictions exist, the antennas can be configured to maximize their reception capabilities. However, in many applications there are severe size limitations placed on the antenna design. Load control terminals that are used in electric utility company systems which regulate customer loads present severe size limitations since the antenna is generally placed inside the load control terminal which is approximately the size of a standard electric meter. Typical load control terminals are generally cylindrical in shape and have a diameter of approximately 6 inches. An antenna that is to be placed within the load control terminal must therefore conform to these size restrictions.

Many different types of antennas are known to those skilled in the art. For example, U.S. Pat. No. 4,222,053 which issued on Sept. 9, 1980 to Newcomb discloses a vertical antenna which is omnidirectional and includes completely automatic band-switching for the amateur radio frequencies of 160 meters, 80–75 meters, 40 meters, 20 meters, 15 meters and 10 meters. The vertical antenna has a low angle of radiation and a low standing wave ratio on all frequencies which permits direct coaxial cable transmission line feed.

U.S. Pat. No. 3,335,420 which issued on Aug. 8, 1967 to Silliman, discloses a dipole antenna with combination feed-support rods. This antenna includes a support or mast section which externally has a metal tube inside of which is a rigid coaxial feed line. The coaxial feeder itself has a rigid outer section and an inner rod. Perpendicular to the mast section are two arm sections which are center-fed. Each arm section includes a hollow metal radiating or receiving cylinder closed at its outer end and open at its inner end. The metal cylinders are each much shorter than a quarter wavelength and each is connected at its inner end internally by electrical connection means including respective rod means that otherwise connect to the coaxial outer section and inner rod.

U.S. Pat. No. 3,448,454 which issued on June 3, 1969 to Lane discloses an omnidirectional circular dipole antenna that is usable to facilitate television reception on small boats. It provides an antenna which possesses nondirectional characteristics for use with television or FM receivers on a moving boat.

U.S. Pat. No. 3,155,976 which issued on Nov. 3, 1964 to Wickersham et al. discloses a broadband straight ladder antenna with twin wire balanced feed supplied via an integral unbalanced line. It is related to an improvement of the operating bandwidth of the Yagi-type antenna while preserving the compactness and structural simplicity of the well-known Yagi-Uda antenna which is one of the simplest and most compact high-gain antennas known to those skilled in the art.

U.S. Pat. No. 4,485,385 which issued on Nov. 27, 1984 to Ralston discloses a broadband antenna that features a diamond-shaped radiator. The radiator can be bent to form a selected dihedral angle to achieve omnidirectivity when a plurality of antennas having reflector screens are used.

When used in conjunction with a load control terminal, an antenna must not only be severely limited in size, but must also provide omnidirectional signal reception and be simple and inexpensive to manufacture. The present invention provides a small omnidirectional antenna that is easy to manufacture and is especially suitable for use in conjunction with load control terminals which are designed to receive and respond to digital information that is broadcast by an FM broadcasting station.

The present invention comprises a dipole segment that includes a conductive rod. This dipole segment is connected in electrical communication with a capacitive segment that comprises an inner, or central, conductor that is disposed within a cylindrical conductor, such as a braided shield. The capacitive segment of the present invention can be provided by using a preselected length of coaxial cable. The central conductor of the coaxial cable is connected in electrical communication with the dipole segment and the cylindrical conductor, or braided shield, is connected to an electrical ground. The present invention also provides an inductor that is connected in electrical communication with the central conductor of the capacitive segment being connected electrically in series between the dipole segment and the inductor. In a preferred embodiment of the present invention, the inductor is a variable inductor.

In one embodiment of the present invention, the dipole segment is a continuation of the central conductor of the capacitive segment with the cylindrical conductor, or braided shield, removed from the dipole segment portion of the present invention. The inductor of the present invention can be provided by anyone of a number of commercially available variable inductors that can be used to permit fine-tuning of the present invention by adjusting the precise inductance of the inductor after manufacture and assembly of the antenna of the present invention within a load control terminal or similar device.

The present invention is usable with a receiver wherein the inductor of the present invention is connected serially between the receiver and the central, or inner, conductor of the capacitive segment and the capacitive segment of the present invention is connected serially between the inductor and the dipole segment.

BRIEF DESCRIPTION OF THE DRAWING

The present invention will be more fully understood from a reading of the description of the preferred embodiment in conjunction with the drawing, in which.

DESCRIPTION OF THE PREFERRED EMBODIMENT

Figure 1:
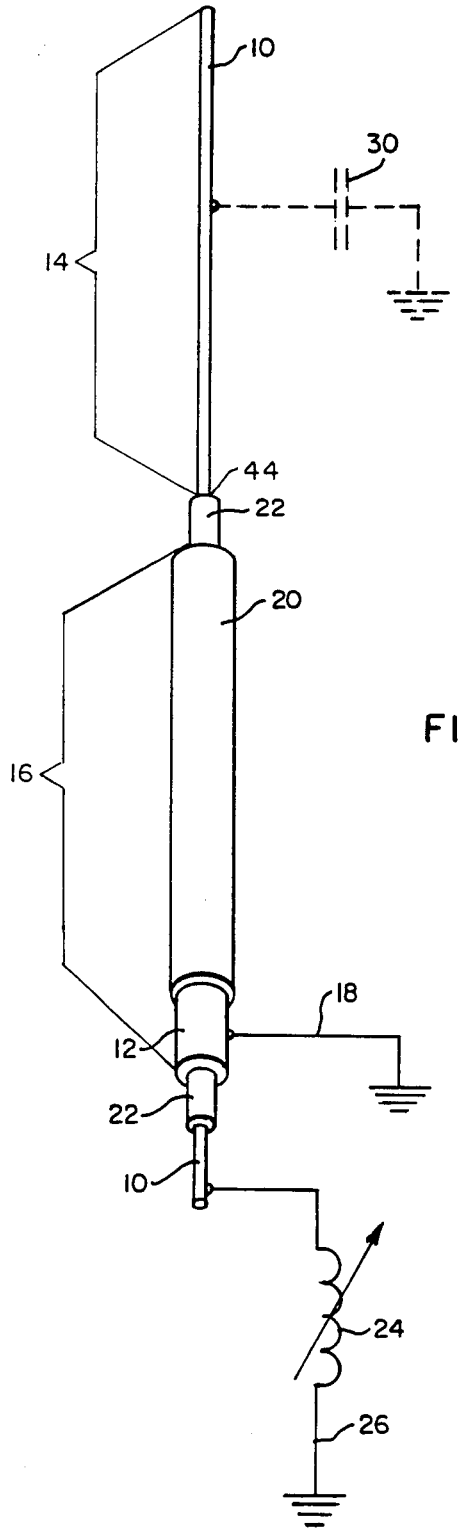
FIG. 1 is a schematic illustration of one embodiment of the present invention.

FIG. 1 illustrates one particular embodiment of the present invention in which a central conductor 10 is partially disposed within a cylindrical conductor 12. The antenna of the present invention, as illustrated in FIG. 1 comrises a dipole segment 14 and a capacitive segment 16. In this particular embodiment of the present invention, the capacitive segment 16 comprises a portion of a coaxial cable having a central conductor 10 disposed within and in coaxial relationship with a cylindrical conductor 12. The cylindrical conductor 12 in a conventional coaxial cable is a braided shield and, when used in conjunction with the present invention, the cylindrical conductor 12 is connected to an electrical ground, as illustrated by line 18. The coaxial cable has an outer insulative covering 20 which is disposed around the cylindrical conductor 12, or braided shield. An inner insulative member 22 is disposed around the central conductor 10 between the central conductor 10 and the cylindrical conductor 12. In typical applications, the inner insulative member 22 is made of a plastic material.

In the specific embodiment of the present invention which is illustrated in FIG. 1, the central conductor 10 is a continuous conductive element that extends through both the capacitive segment and the dipole segment of the antenna. A portion of the central conductor 10 extends from one end of the capacitive segment 16 and serves as the dipole segment 14. Another portion of the central conductor 10 extends from the other end of the capacitive segment 16 and is connected in electrical communication with an inductor 24 which is, in turn, connected to an electrical ground as indicated by line 26. By extending the central conductor 10 from the dipole segment 14 through the inner insulative covering 22 and through the capacitive segment 16 to the inductor 24, one skilled in the art can determine that the signal is fed from the point the dipole segment 14 ends, this point being the upper end of the inner insulative covering 22, and being designated as reference numeral 44. It is also known that the inductor 24 can comprise a portion of the receiving or transmitting device (not shown) thereby coupling the signal between the antenna and such external device (not shown). In a preferred embodiment of the present invention, the inductor 24 is a variable inductor such as Style No. SK-138-1 series coil which is available in commercial quantities from Standex Electronics Corporation. This particular type of variable inductor has a ⅜-inch core of carbonyl (J) and provides a variable inductor with 4½ turns and an inductance range of 0.110 microhenry to 0.176 microhenry.

As is known to those skilled in the art, the frequency of an antenna can be determined, as a function of inductance and capacitance, by the equation $$f=1/(2\pi\ LC) \quad (1)$$

which can be restated as $$C_T=25330.295/Lf^2 \quad (2)$$

to define the total capacitance $C_T$ of the antenna as a function of the inductance L, in microhenrys, and the frequency f, in megahertz. This equation determines the capacitance, in picofarads, that is required to tune the antenna to the desired broadcasting frequency with a given inductance L. For purpose of explanation, this relationship between total capacitance $C_T$, inductance L and frequency f will be illustrated using an example of a variable inductor that provides an inductance range from 0.110 microhenry to 0.176 microhenry. Table I represents a tabulation of the capacitance values resulting from solution of Equation (2), above, for a broadcast band of 88–108 megahertz and various inductances within the range of the variable inductor.

TABLE I

| Inductance (L) | Total Capacitance ($C_T$) 88 MHZ | 98 MHZ | 108 MHZ |
|---|---|---|---|
| .110 μH | 29.736 pf | 23.977 pf | 19.742 pf |
| .120 μH | 27.258 pf | 21.979 pf | 18.097 pf |
| .130 μH | 25.161 pf | 20.288 pf | 16.705 pf |
| .140 μH | 23.364 pf | 18.839 pf | 15.512 pf |
| .143 μH | 22.874 pf | 18.444 pf | 15.186 pf |
| .150 μH | 21.806 pf | 17.583 pf | 14.478 pf |
| .160 μH | 20.440 pf | 16.484 pf | 13.573 pf |
| .170 μH | 19.241 pf | 15.515 pf | 12.774 pf |
| .176 μH | 18.585 pf | 14.986 pf | 12.339 pf |

Figure 3:
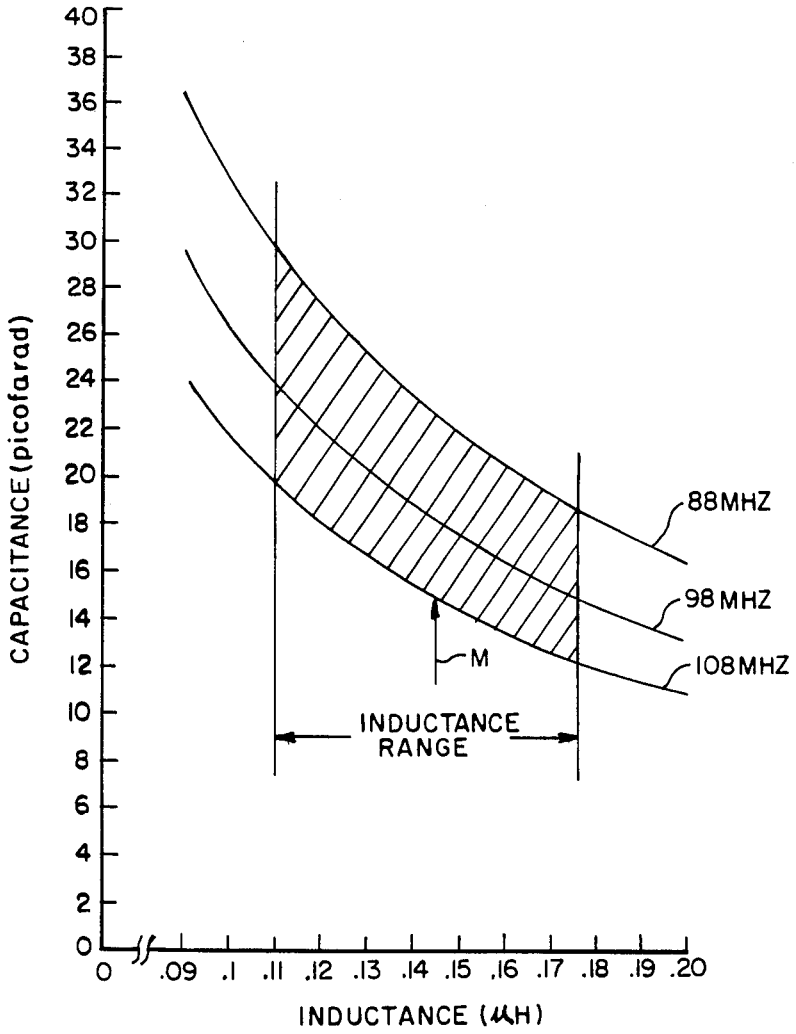
FIG. 3 is a graphical representation of the relationship between the inductance of the inductor of the present invention and the required capacitance to achieve a proper frequency sensitivity.

FIG. 3 illustrates a graphical representation of the relationship between inductance and capacitance as described in Equation (2) and as illustrated numerically in Table I. In FIG. 3, the three curves represent the relationship between inductance and capacitance for three specific frequencies. These frequencies represent the low, mid and high points of the desired frequency band for one particular embodiment of the present invention which is designed to receive an FM broadcast signal that is in the 88–108 megahertz band. The shaded portion of FIG. 3 represents the capacitance values for the inductance range of the specific variable inductor described above. It should be understood that this particular example is used to illustrate only one specific embodiment of the present invention and does not represent a limitation of the present invention. Other types of variable inductors with different inductance ranges can be used in place of the variable inductor described and illustrated in this example.

Equation (2), above, defines the total capacitance $C_T$ as a function of the inductance and frequency. Referring again to FIG. 1, it should be understood that both the dipole segment 14 and capacitive segment 16 of the antenna are capacitive. The capacitance of the capacitive segment 16 is easily determinable if a coaxial cable is used to provide this portion of the antenna. For example, coaxial cable is obtainable in commercial quantities from various manufacturers, such as the Belden Corporation, and a particular coaxial cable is available that is described in the manufacturer's specification book Ex. RG/58 as having a capacitance of 39 picofarads per foot or 3.25 picofarads per inch. It should also be understood that the dipole segment 14 of the present invention is capacitive ir this segment is shorter than ¼ wavelength of the broadcast frequency. As is known to those skilled in the art, the length of a quarter wave $l_{¼}$ can be determined by the equation $$l_{¼}=234/f \quad (3)$$

in which the frequency, in megahertz, can be used to determine the length of a quarter wave $l_{¼}$ in feet. Using Equation (3), it can readily be determined that a quarter wavelength for a frequency of 98 megahertz (the midpoint in the illustrated broadcast band) is 2.3878 feet, or 28.653 inches. Since the antenna illustrated in FIG. 1 is particularly designed to be used within a confined space, such as a load control terminal, it can be safely assumed for purposes of this illustration that the length of the dipole segment 14 is less than ¼ wavelength. Therefore, it is capacitive in nature. This characteristic is illustrated schematically in FIG. 1 by the dashed line capacitor 30. The capacitance of the dipole segment, or antenna segment, is defined by the equation $$C_a=17\ l_a/[(\ln(24\ l_a/D)-1)\ (1-(fl_a/234)^2)] \quad (4)$$

in which $l_a$ is the length of the dipole segment 14 in feet, D is the diameter of the dipole segment 14 in inches, and f is the frequency of the broadcast signal, in megahertz, to be received. The results of Equation (4) give the effective capacitance $C_a$, in picofarads, of the dipole segment 14, as schematically illustrated by capacitor 30 in FIG. 1.

In the usual case, where the capacitance of the dipole segment 14 $C_a$ is significantly less than the required capacitance $C_T$, additional capacitance must be provided to satisfy Equation (2) for a preselected frequency. This additional capacitance is conveniently provided by connecting the capacitive segment 16 to the dipole segment 14 as illustrated in FIG. 1. When coaxial cable is used as the capacitive segment 16, its capacitance can be easily and accurately determined by the equation $$C_c=(l_c)(K) \quad (5)$$

which gives the capacitance $C_c$ of the capacitive segment 16 in terms of the length $l_c$ of the coaxial cable multiplied by a constant K which represents the capacitance per unit length for the coaxial cable.

As can be seen in FIG. 1, the resulting capacitances of the dipole segment 14 and capacitive segment 16 are effectively parallel and, thus, are additive. Therefore, the total capacitance $C_T$ can be defined by $$C_T=C_a+C_c$$

in terms of the capacitance $C_a$ of the antenna (the dipole segment 14) and the capacitance $C_c$ of the coaxial cable. Referring again to FIG. 3, it can be seen that the midpoint of the inductance range, illustrated by arrow M, at 0.143 microhenry, corresponds with a capacitance $C_T$ of approximately 18,444 picofarads for the midpoint of the broadcast band (i.e., 98 megahertz). Using this information, which is a function of the available variable inductor described above, the total required capacitance $C_T$ can be determined. As discussed above in relation to Equation (4), the capacitance $C_a$ of the dipole antenna is defined in terms of the length $l_a$ and diameter D of the dipole segment 14. If the diameter of the dipole segment 14 is preselected, the antenna's capacitance $C_a$ can be determined as a function of the length $l_a$.

In a development prototype of the present invention, a conductive rod having a diameter of 0.106 inch was used. Table II illustrates the effective capacitance $C_a$ of the dipole antenna for various lengths $l_a$ of the dipole segment 14, of the present invention.

TABLE II

| | | Capacitance of Dipole ($C_a$) | | |
|---|---|---|---|---|
| $l_a$ (inches) | $l_a$ (feet) | 88 MHZ | 98 MHZ | 108 MHZ |
| 0 | 0 | 0 pf | 0 pf | 0 pf |
| 1 | .08333 | .732 pf | .732 pf | .732 pf |
| 2 | .16666 | 1.081 pf | 1.082 pf | 1.083 pf |
| 3 | .25000 | 1.412 pf | 1.415 pf | 1.419 pf |
| 4 | .33333 | 1.732 pf | 1.739 pf | 1.746 pf |
| 5 | .41666 | 2.047 pf | 2.060 pf | 2.074 pf |
| 6 | .50000 | 2.363 pf | 2.384 pf | 2.408 pf |

Figure 4:
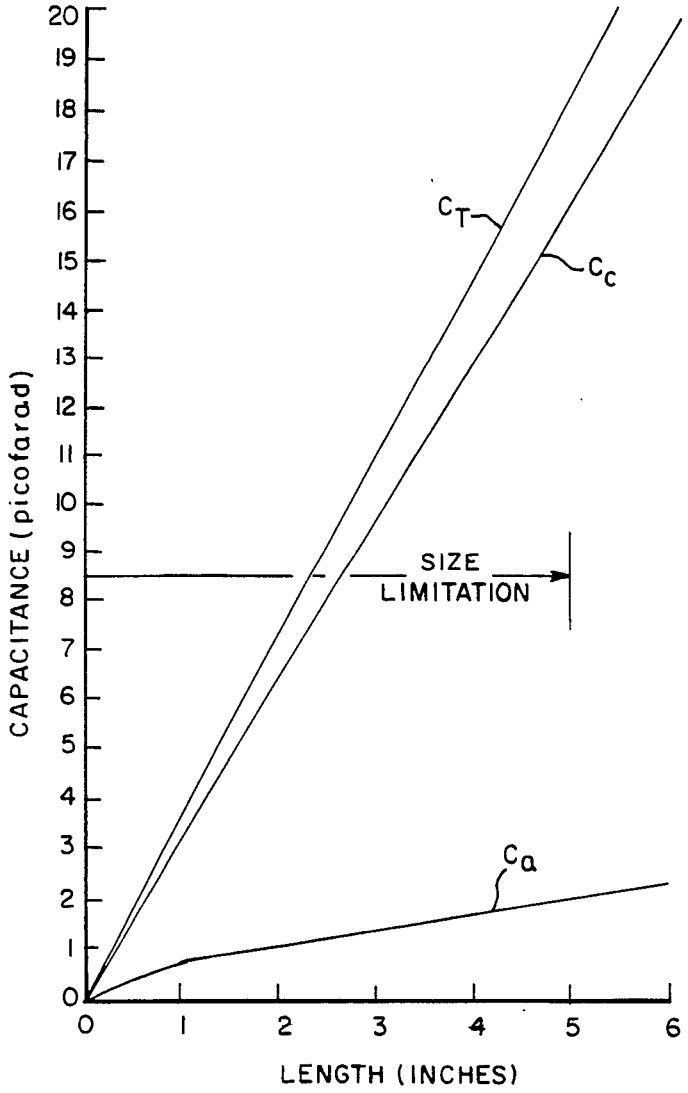
FIG. 4 is a graphical representation of the relationship between the capacitances of the antenna and capacitive segments in one particular embodiment of the present invention.

As can be seen from Table II, the dipole capacitance $C_a$ varies significantly as a function of the length of the dipole segment 14, but does not vary as significantly as a function of the broadcast frequency. FIG. 4 graphically represents, as curve $C_a$, the relationship between the length of the dipole segment and its capacitance. Also illustrated in FIG. 4 is the relationship between the length of the capacitive segment 16 and its capacitance. This is illustrated by the line $C_c$ which is a graphical representation of Equation (5). For purposes of this illustration, a coaxial cable having an effective capacitance per foot of 39 picofarads (constant K in Equation (5)) and a dipole segment 14 having a diameter of 0.106 inch was used.

In some applications of the present invention, it is desirable to design the antenna with a dipole segment 14 which is generally equal in length to the capacitive segment 16. It should be clearly understood that this equality is not a requirement of the present invention, but can provide a convenient physical configuration in certain applications. If it is desirable to design the antenna with a dipole segment 14 which is generally equal in length to the capacitive segment 16, the graphical representation of FIG. 4 can be used. Referring to FIGS. 3 and 4, it can be seen that, at the midpoint M of the inductance range, a total capacitance $C_T$ of 18.444 picofarads is indicated. Referring to FIG. 4, it can be seen that a total capacitance $C_T$ of 18.444 picofarads can be provided by using a dipole segment and a capacitive segment which are each approximately 5 inches long. As illustrated in FIG. 4, the particular load management terminal for which the present invention is intended presents a size limitation of approximately 5 inches. This size limitation results from the limited diameter of the cylindrically shaped load management terminal. Therefore, the effective length of the antenna must be less than or equal to 5 inches. A prior art FM antenna which has been utilized in such a confined space, has typically been configured as a loop antenna for which it is known that the associated wave pattern is in the form of a figure eight about the loop of the antenna. This antenna, when placed in close proximity to receiver components, has resulted in feedback problems which result in detrimental effects on the receiver circuitry and on the incoming signal. By configuring the antenna in the manner shown in FIGS. 1 and 2, the invention as embodied therein, results in a wave pattern that is circular about the antenna itself and does not incur the inherent feedback problems of the loop antenna.

At this point in the illustration, it should be noted that the calculated capacitance of the dipole, which is illustrated numerically in Table II and shown graphically in FIG. 4, is based on the assumption that the dipole is located in space and is not proximate any other conductors which may affect its capacitance. Those skilled in the art are well aware of the fact that this theoretical assumption is seldom achievable in practice. The antenna is usually disposed proximate other conductors which effect its capacitance that was theoretically determined from Equation (4), above. This is especially true when the present invention is used in a relatively small load management terminal which contains many other conductive components that, when disposed proximate the dipole, severely effect its capacitance. Although this physical condition only slightly effects the capacitance of the capacitive segment 16, it can potentially increase the capacitance of the dipole segment by a significant amount. Although it is difficult to precisely calculate this effect theoretically, those skilled in the art are aware that it occurs and can therefore take this effect into account when designing an antenna in accordance with the present invention. Therefore, it should be understood that the results graphically illustrated in FIG. 4 are theoretical and, in actual practice, it can be expected that a dipole segment and a capacitive segment that are considerably shorter than 5 inches in length can be used to provide the required capacitance $C_T$ as calculated by Equation (2) above. It should also be understood that implementation of the present invention involves both theoretical and empirical determinations. The theoretical determinations are described in conjunction with the above illustration. The empirical determinations will vary depending on the surrounding components that are disposed proximate the present invention. The components can effect the capacitance of the dipole segment (Reference No. 14 in FIG. 1) and thus effect the total capacitance $C_T$. However, it should also be understood that the use of the variable inductor (Reference No. 24 in FIG. 1) facilitates this empirical determination. For example, after the theoretical capacitances are determined and the antenna is connected to a receiver and disposed in its final configuration, the variable inductor permits the present invention to be fine-tuned for the particular frequency band that is to be received by the antenna. These concepts will be described in conjunction with the following example which relates to FIG. 2.

Figure 2:
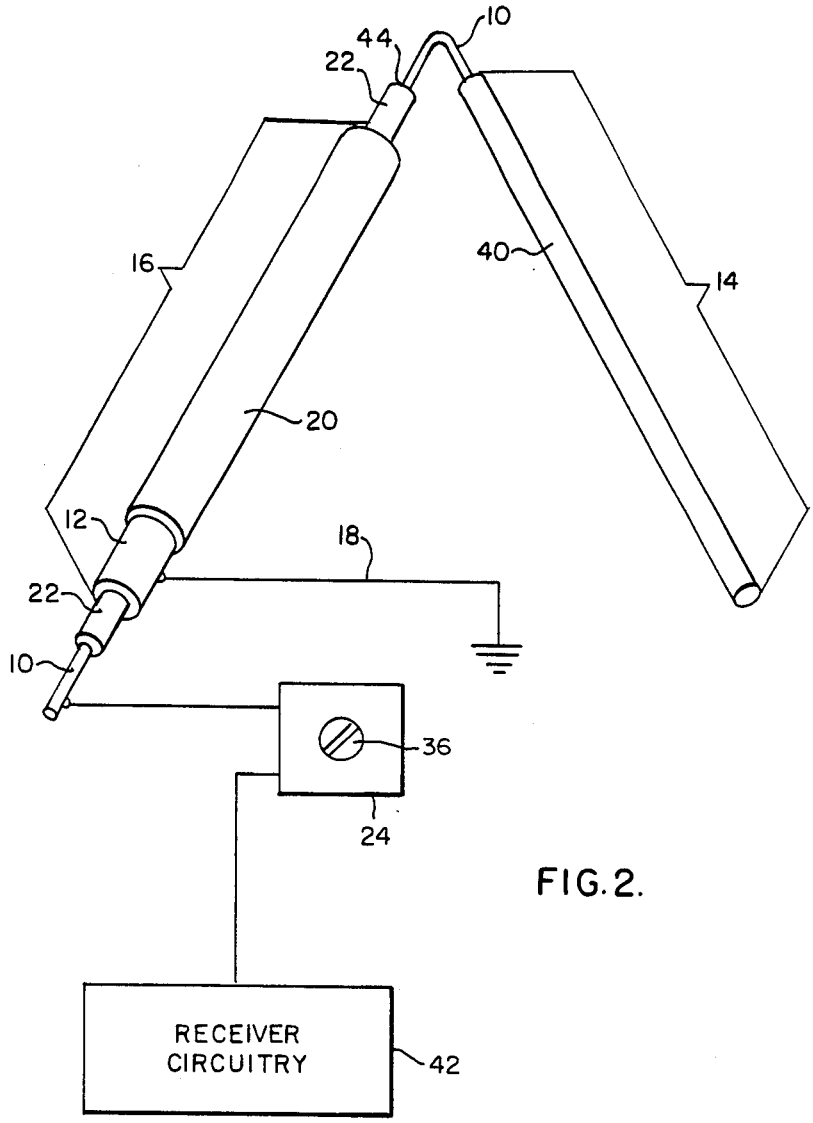
FIG. 2 is an illustration of one specific embodiment of the present invention in which a generally rigid rod is used as its dipole segment.

FIG. 2 illustrates a particular embodiment that has been experimentally developed as a prototype antenna. As can be seen, this embodiment of the present invention has been configured as a V-shape in order to reduce its effective length for purposes of permitting its installation in a load management terminal. The capacitive segment 16 is similar to that described in relation to FIG. 1, above. However, the central conductor 10 of the coaxial cable is not extended, as illustrated in FIG. 1, to form the dipole segment 14. Instead, a conductive rod 40 is connected in electrical communication to the central conductor 10. The added stiffness and increased diameter of the conductive rod 40 permit both the coaxial cable and conductive rod to be more firmly attached within a receiving device. The other end of the central conductor 10 is connected to a variable inductor 24 whose inductance can be increased or decreased by rotating the adjustment screw 36. The variable inductor 24 is functionally equivalent to the schematic illustration of the variable inductor 24 in FIG. 1.

The variable inductor 24, as illustrated in FIG. 2, is connected in electrical and signal communication with appropriate receiver circuitry 42. As discussed above, the cylindrical conductor 12, such as the braided shield of a coaxial cable, is electrically connected to ground as illustrated by line 18.

The developmental prototype of the present invention, which is similar to the one illustrated in FIG. 2, was provided with a dipole segment 14 that has a diameter of 0.106 inch and a length $l_a$ of 3.6 inches (0.3 feet). Furthermore, the length of the capacitive segment 16 was 3 inches. The variable inductor 24 has an inductance range of 0.10 microhenry to 0.176 microhenry with a midpoint in the range approximately equivalent to 0.143 microhenry. Using Equation (4), it can be determined that, for a frequency of 98 megahertz, the capacitance $C_a$ of the dipole is 1.610 picofarads. Furthermore, since a coaxial cable having a constant K of 39 picofarads per foot, as defined above in relation to Equation (5), was used in the developmental prototype, the capacitance of the capacitive segment 16 is defined as 9.750 picofarads. By using Equation (6), above, it can be determined that the combined capacitances of the dipole segment 14 and the capacitive segment 16 is 11.360 picofarads.

When the midpoint of the inductance range for the variable inductor 24 is used in conjunction with FIG. 3, it can be determined that a total capacitance $C_T$ of between 15.186 picofarads and 22.874 picofarads is required. The midpoint of this range is approximately 18.444 picofarads. Using the midpoint as a reference, it would appear that the total capacitance $C_T$ of 11.360 picofarads that is provided by the dipole segment 14 and the capacitive segment 16 is insufficient. Theoretically this is true. However, it has been empirically determined that the actual capacitance $C_a$ of the dipole segment 14 is increased when it is disposed proximate other conductive elements. Furthermore, after the antenna is installed proximate these conductive elements and the effective capacitance of the dipole is increased, the variable inductor 24 permits the receiver and antenna to be fine-tuned to receive the frequency of the predetermined broadcast band.

Since the present invention is intended for mass production of a large number of receivers, it should be understood that the particular design of any particular embodiment of the present invention involves both theoretical and empirical determinations. The theoretical determinations, as described above, relate to Equations (1)–(6) and result in theoretical values for total capacitance $C_T$ and the lengths of the dipole segment 14 and capacitive segment 16 that result in particular capacitances (i.e., $C_a$ and $C_c$) that are additive and result in the desired total capacitance. As also described above, the effective capacitance of the dipole segment 14 can be increased by its being disposed proximate other conductive elements. Since the present invention is usually disposed within a receiver structure that contains many other conductive components, it can be assumed that the capacitance of the dipole segment 14 will actually be slightly higher than that calculated by Equation (4). This actual discrepancy can be accommodated by using a capacitive segment 16 which is shorter than the required length calculated by Equation (6) or by adjusting the variable inductor 24 after assembly of the antenna within its associated receiver device. After these empirical determinations are made during the design of the first antenna, many other antennas can be mass-produced subsequently according to the results obtained during both the theoretical and empirical determinations described herein. Any minor discrepancies that are encountered during the subsequent manufacture of antennas can be accommodated by fine-tuning the antenna and receiver circuitry with adjustments of the variable inductors 24 to maximize the effectiveness of the receiver and antenna in relation to the desired frequency of the broadcast band.

The present invention provides an FM antenna that is relatively small in size and is omnidirectional for receipt of FM broadcast signals. Furthermore, the present invention utilizes a capacitive segment that is inexpensive. The combination of the dipole segment, the capacitive segment and the variable inductor of the present invention is easily manufactured and installed in conjunction with receiver circuitry. Although the present invention has been described in considerable detail and with specific examples relating to a developmental prototype, it should be understood that the present invention is not so limited and that other embodiments are embodiments are to be considered within the scope of the present invention.

What I claim is:

1. An FM antenna of a load control device, comprising:

a dipole segment comprising a conductive rod having a first capacitive value associated therewith;

a capacitive segment having a central conductor disposed within a cylindrical conductor, said central and cylindrical conductors being arranged in coaxial association, said central conductor being electrically insulated from said cylindrical conductor, said central conductor being connected in electrical communication with said conductive rod;

an inductor being connected in electrical communication with said central conductor, said central conductor being connected serially between said conductive rod and said inductor;

said dipole segment and said capacitive segment being selectively balanced in length so as to achieve a summed capacitive value which, in conjunction with said inductor, establishes a preselectable resonant frequency at which said FM antenna is operable;

said cylindrical conductor being connected in electrical communication with an electrical ground; and said cylindrical rod is disposed at an angle relative to said conductive rod so that the length of said FM antenna is reduced sufficiently to be disposed within said load control device.

2. The antenna of claim 1, wherein:

said capacitive segment comprises a coaxial cable.

3. The antenna of claim 1, further comprising:

an FM receiver being connected in signal communication with said inductor, said inductor being connected serially between said FM receiver and said central conductor.

4. The antenna of claim 1, wherein:

said conductive rod and said central conductor are generally equal in length.

5. An antenna as set forth in claim 4 wherein:

said conductive rod and said central conductor are selectively balanced in length so as to achieve an overall length of less than 6 inches.

6. An FM antenna as set forth in claim 1 wherein:

such balancing of the lengths of said capacitive segment and said dipole segment is effective such that said respective lengths are approximately equal to one another and said angle between said capacitive segment and said dipole segment results in a V-shaped configuration of said antenna.

7. An FM antenna as set forth in claim 6 wherein:

said dipole segment can be increased in diameter to effect an increase in the capacitive value associated therewith so as to achieve said summed capacitive value and maintain such approximate equality of said two lengths simultaneously.

* * * * *